US008884237B2

(12) United States Patent
Downing et al.

(10) Patent No.: US 8,884,237 B2
(45) Date of Patent: Nov. 11, 2014

(54) NEUTRON DETECTION

(75) Inventors: R. Gregory Downing, Niskayuna, NY (US); Bruce Feller, Sturbridge, MA (US)

(73) Assignee: Nova Scientific, Inc., Sturbridge, MA (US)

( * ) Notice: Subject to any disclaimer, the term of this patent is extended or adjusted under 35 U.S.C. 154(b) by 696 days.

(21) Appl. No.: 12/867,179

(22) PCT Filed: Feb. 11, 2009

(86) PCT No.: PCT/US2009/033764

§ 371 (c)(1),
(2), (4) Date: Sep. 20, 2010

(87) PCT Pub. No.: WO2009/102768

PCT Pub. Date: Aug. 20, 2009

(65) Prior Publication Data

US 2011/0006206 A1 Jan. 13, 2011

Related U.S. Application Data

(60) Provisional application No. 61/027,939, filed on Feb. 12, 2008.

(51) Int. Cl.
*H01J 49/44* (2006.01)
*H01J 47/12* (2006.01)

(52) U.S. Cl.
CPC ..... *H01J 47/1222* (2013.01)
USPC ..... 250/370.05; 250/305

(58) Field of Classification Search
USPC ..... 250/370.05
See application file for complete search history.

(56) References Cited

U.S. PATENT DOCUMENTS

| | | | | |
|---|---|---|---|---|
| 3,939,374 | A * | 2/1976 | Schagen et al. | 313/534 |
| 4,825,118 | A * | 4/1989 | Kyushima | 313/104 |
| 5,294,577 | A * | 3/1994 | Yamamoto et al. | 501/134 |
| 5,811,820 | A * | 9/1998 | Kirchner et al. | 250/432 R |
| 6,455,987 | B1 * | 9/2002 | Durst et al. | 313/103 R |
| 6,623,969 | B1 * | 9/2003 | Willson, III | 506/11 |
| 7,265,359 | B2 | 9/2007 | Ambrosi et al. | 250/390.01 |
| 7,333,701 | B1 | 2/2008 | Feller et al. | 385/123 |
| 7,791,038 | B2 | 9/2010 | Zhong et al. | 250/390.01 |
| 8,173,967 | B2 | 5/2012 | Feller et al. | 250/366 |
| 8,207,506 | B2 * | 6/2012 | Zhong et al. | 250/390.01 |
| 2003/0178574 | A1 | 9/2003 | Wallace et al. | 250/390.11 |
| 2003/0205956 | A1 * | 11/2003 | Downing et al. | 313/104 |
| 2005/0048351 | A1 * | 3/2005 | Hood et al. | 429/38 |
| 2005/0136529 | A1 | 6/2005 | Yang et al. | 435/287.1 |
| 2007/0132351 | A1 | 6/2007 | Downing et al. | 313/103 |

OTHER PUBLICATIONS

International Search Report, International Application PCT/US2009/033764, 2 pages, Apr. 16, 2009.

* cited by examiner

*Primary Examiner* — David Porta
*Assistant Examiner* — Djura Malevic
(74) *Attorney, Agent, or Firm* — Fish & Richardson P.C.

(57) ABSTRACT

In exemplary embodiments, an apparatus, includes a first electrode, a second electrode, a first polygonal channel extending between the electrodes, the first channel having a first side having a center, and a second polygonal channel extending between the electrodes, the second channel having a second side contacting the first side, the second side having a center, wherein the center of the first side and the center of the second side are non-collinear in a direction perpendicular to a surface of the first side, and wherein the first and second channels do not have square cross sections perpendicular to longitudinal axes of the channels.

20 Claims, 3 Drawing Sheets

NEUTRON DETECTION

CROSS REFERENCE TO RELATED APPLICATIONS

This application is the National Stage of International Application No. PCT/US2009/033764, filed Feb. 11, 2009, which claims priority to U.S. Provisional Application No. 61/027,939, filed Feb. 12, 2008. The above applications are incorporated herein by reference.

TECHNICAL FIELD

The invention relates to neutron detection, such as, for example, neutron detectors and methods of detecting neutrons.

BACKGROUND

Neutrons can be detected to indicate the presence of special nuclear materials, such as plutonium, or to be used in neutron imaging. An example of a neutron detector is one that includes a neutron-sensitive microchannel plate (MCP). An MCP can be formed by bonding a glass plate between an input electrode and an output electrode, and providing a high voltage direct current (DC) field between the electrodes. The glass plate includes a substantially regular, parallel array of microscopic channels, e.g., cylindrical and hollow channels. Each channel, which can serve as an independent electron multiplier, has an inner wall surface formed of a semi-conductive and electron emissive layer.

The MCP can be made neutron-sensitive by doping the glass plate with, e.g., boron-10 particles, which can capture neutrons in reactions that generate alpha and lithium-7 particles. As the alpha and lithium-7 particles enter nearby channels and collide against the wall surfaces to produce secondary electrons, a cascade of electrons can be formed as the secondary electrons accelerate along the channels (due to the DC field), and collide against the wall surfaces farther along the channels, thereby increasing the number of secondary electrons. The electron cascades develop along the channels and are amplified into detectable signals that are electronically registered and sometimes processed to construct an image.

SUMMARY

In one aspect, the invention features an apparatus including a first electrode, a second electrode, a first polygonal channel extending between the electrodes, the first channel having a first side having a center, and a second polygonal channel extending between the electrodes, the second channel having a second side contacting the first side, the second side having a center, wherein the center of the first side and the center of the second side are non-collinear in a direction perpendicular to a length of the first side.

Embodiments may include one or more of the following features. The first and second channels have three sides each. The first and second channels have four sides each. The first and second channels have square cross sections perpendicular to longitudinal axes of the channels. The first and second channels have rectangular cross sections perpendicular to longitudinal axes of the channels. The rectangular cross sections have an aspect ratio greater than 1.5:1. The rectangular cross sections have an aspect ratio of equal to or greater than approximately 2:1. The channels include a composition capable of interacting with neutrons to form secondary electrons inside the microchannel. The composition includes boron-10 isotope, natural gadolinium, both boron-10 isotope and natural gadolinium, or lithium-6 isotope. The channels include a composition having an electron emissive portion. The center of the first side and the center of the second side are spaced in a direction parallel to the first side by greater than or equal to approximately 10% of a distance of the first side. The center of the first side and the center of the second side are spaced in a direction parallel to the first side by greater than or equal to approximately 20% of a distance of the first side.

In another aspect, the invention features an apparatus including a first electrode; a second electrode; a first channel extending between the electrodes; and a second channel extending between the electrodes, wherein the first and second channels have rectangular cross sections perpendicular to longitudinal axes of the channels.

Embodiments may include one or more of the following features. The rectangular cross sections have an aspect ratio of equal to or greater than approximately 1.5:1. The channels have a composition capable of interacting with neutrons to form secondary electrons inside the microchannel. The composition includes boron-10 isotope, natural gadolinium, or both boron-10 isotope and natural gadolinium, or lithium-6 isotope. The channels have a composition comprising an electron emissive portion.

In another aspect, the invention features a method including contacting an apparatus with particles, the apparatus including a first electrode, a second electrode, a first polygonal channel extending between the electrodes, the first channel having a first side having a center, and a second polygonal channel extending between the electrodes, the second channel having a second side contacting the first side, the second side having a center, wherein the center of the first side and the center of the second side are non-collinear in a direction perpendicular to a surface of the first side; and detecting electrons formed by contacting the apparatus with the particles.

Embodiments may include one or more of the following features. The particles include neutrons. The first and second channels have only three sides each. The first and second channels have only four sides each. The first and second channels have square cross sections perpendicular to longitudinal axes of the channels. The first and second channels have rectangular cross sections perpendicular to longitudinal axes of the channels. The rectangular cross sections have an aspect ratio greater than 1.5:1. The rectangular cross sections have an aspect ratio of equal to or greater than approximately 2:1. The composition includes boron-10 isotope, natural gadolinium, both boron-10 isotope and natural gadolinium, or lithium-6 isotope. The channels include a composition having an electron emissive portion. The center of the first side and the center of the second side are spaced in a direction parallel to the first side by greater than or equal to approximately 10% of a distance of the first side. The center of the first side and the center of the second side are spaced in a direction parallel to the first side by greater than or equal to approximately 20% of a distance of the first side.

In another aspect, the invention features a method, including contacting an apparatus with particles, the apparatus including a first electrode, a second electrode, a first channel extending between the electrodes, and a second channel extending between the electrodes, wherein the first and second channels have rectangular cross sections perpendicular to longitudinal axes of the channels; and detecting electrons formed by contacting the apparatus with the particles.

Embodiments may include one or more of the following features. The rectangular cross sections have an aspect ratio of equal to or greater than approximately 1.5:1. The rectangular cross sections have an aspect ratio of equal to or greater than approximately 2:1. The composition includes boron-10 isotope, natural gadolinium, both boron-10 isotope and natural gadolinium, or lithium-6 isotope. The channels include a composition having an electron emissive portion.

Details of one or more embodiments are set forth in the accompanying description below. Other aspects, features, and advantages of the invention will be apparent from the following drawings, detailed description of embodiments, and also from the appending claims.

DETAILED DESCRIPTION

Figure 1:
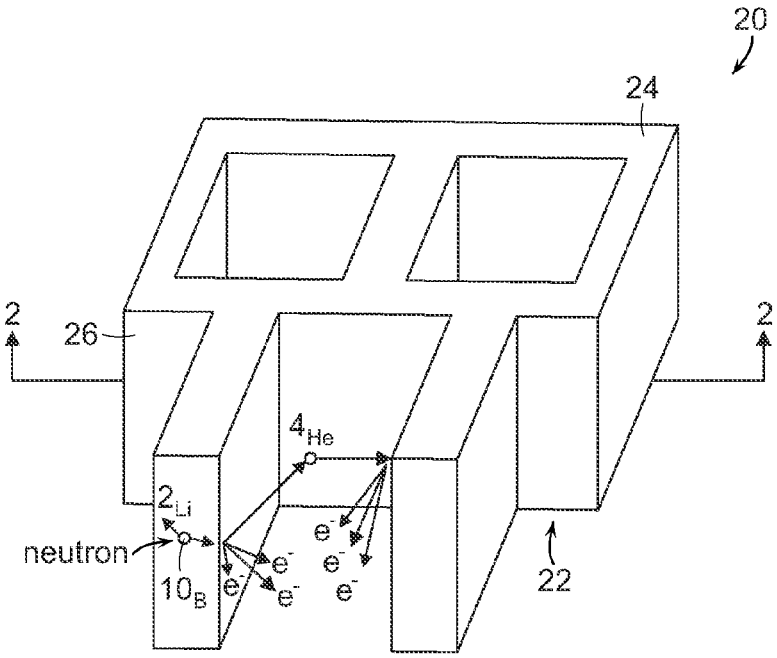
FIG. 1 is a schematic diagram of an embodiment of a neutron detector.
Figure 2:
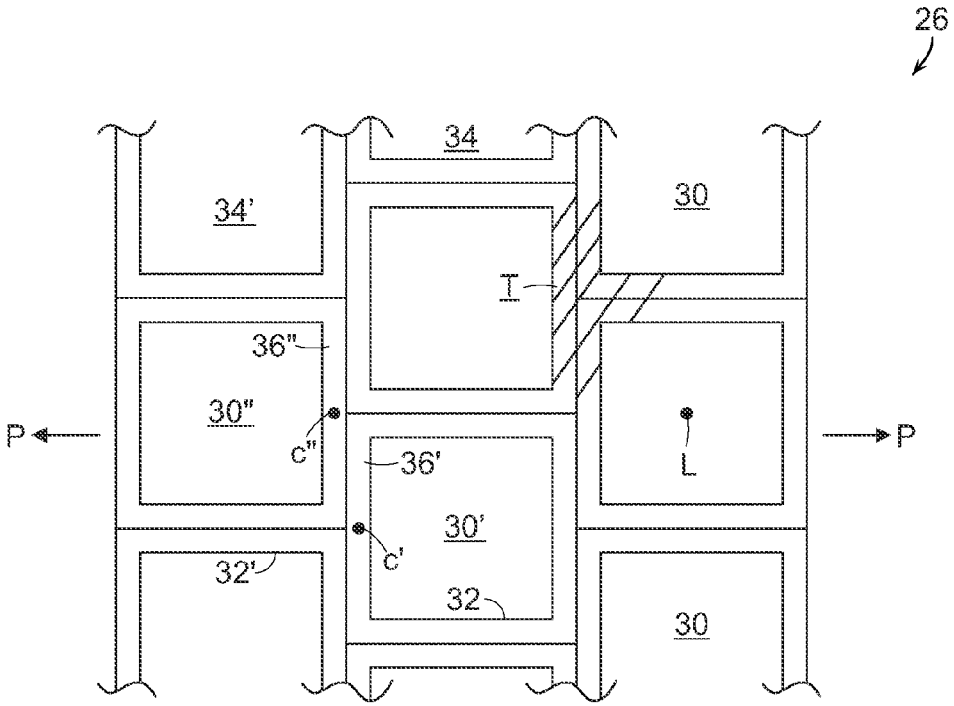
FIG. 2 is a cross-sectional view taken along line 2-2 in FIG. 1.

FIG. 1 shows an embodiment of a neutron detector 20 including a first electrode 24, a second electrode 22, and a microchannel plate (MCP) 26 between the electrodes. Referring to FIG. 2, MCP 26 includes an array made of a plurality of channels 30 bonded together such that the channels extend lengthwise from first electrode 22 to second electrode 24. As shown, channels 30 extend along longitudinal axis L and are generally perpendicular to electrodes 22, 24. MCP 26 includes (e.g., is formed of) a composition, such as a glass, that can be made neutron-sensitive by doping with, e.g., boron-10 particles. During use, incident neutrons can interact with the neutron-sensitive composition to generate, for example, alpha and lithium-7 particles. The alpha and lithium-7 particles can enter nearby channels and collide against the wall surfaces to produce secondary electrons. In the case of a neutron—Gd interaction, fast electrons are created, and in turn enter nearby channels and collide against the wall surfaces to produce secondary electrons. In the case of a lithium-6 isotope, alpha and $^{3}H$ (triton) particles are formed, which also produce secondary electrons in a similar manner. A cascade of electrons can be formed as the secondary electrons accelerate along the channels (due to a DC field between electrodes 22, 24) and collide against the wall surfaces farther along the channels, thereby increasing the number of secondary electrons. The electron cascades can develop along the channels and can be amplified into detectable signals that are electronically registered and/or processed to construct an image.

Referring particularly to FIG. 2, in some embodiments, MCP 26 includes an array of non-circular channels 30 having cross sections (as taken perpendicularly to the length of the channels) that are polygonal, as shown, square. Channels 30 are connected (e.g., fused or bonded) together such that a first wall 32 between two channels in a first row 34 is offset and non-collinear with a second wall 32' nearest to the first wall 32 and between two channels in a second row 34' next to the first row 34. As a result, the arrangement of channels 30 is staggered, similar to the arrangement of bricks in a brick wall. Expressed another way, MCP 26 includes a first channel 30' having a side 36' with a center C', and a second channel 30" having a side 36" contacting side 36' with a center C". Centers C', C" are non-collinear in a direction perpendicular (line P) to the surface of side 36'. In contrast, referring to FIG. 3, in other MCPs, channels 40 are connected together such that a first wall 42 between two channels in a first row 44 is collinear with a second wall 42' that is nearest to the first wall 42 and between two channels in a second row 44' next to the first row 44. Expressed another way, a first channel 40' having a side 46' with a center M', and a second channel 40" having a side 46" contacting side 46' with a center M". Centers M', M" are collinear in a direction perpendicular (line P) to the surface (S) of side 46'.

Figure 3:
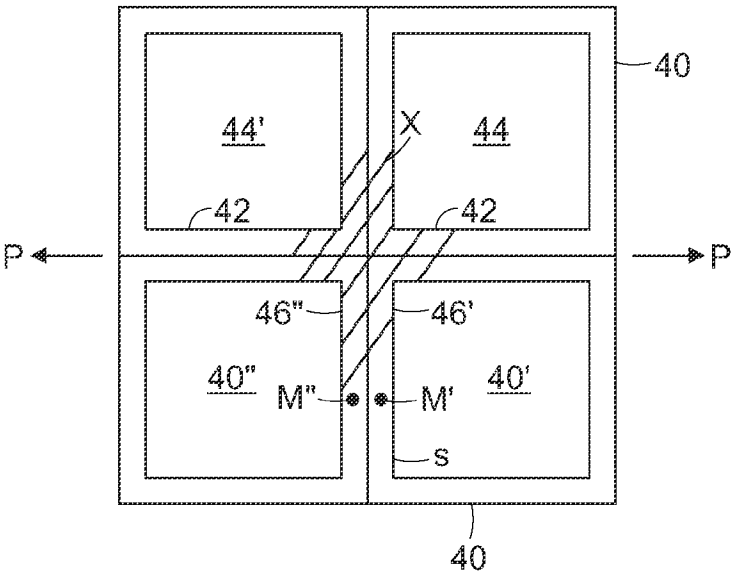
FIG. 3 is a schematic diagram of an embodiment of a microchannel plate.

Without being by bound by theory, it is believed that an MCP having the arrangement of channels 30 shown in FIG. 2 is capable of having enhanced performance relative an MCP having the arrangement of channels 40 shown in FIG. 3, given that the channels are otherwise the same. As shown in FIG. 2, when channels 30 are joined together, they form junctions (T) that are T-shaped in cross section. In comparison, referring to FIG. 3, when channels 40 are joined together, they form junctions (X) that are X-shaped or +-shaped in cross section. A T-shaped junction (T) has less bulk or volume than an X-shaped junction (X). As a result, compared to X-shaped junctions (X), the products generated within the bulk of T-shaped junctions (T) from the interactions of neutrons with the MCP composition have an increased probability of escaping from the bulk. An increased escape probability means that the products (such as lithium-7 and alpha particles) can more easily enter nearby channels and collide against the wall surfaces to produce secondary electrons, which can produce a greater cascade of electrons and more detectable signal. A higher neutron detection efficiency can result.

Figure 4:
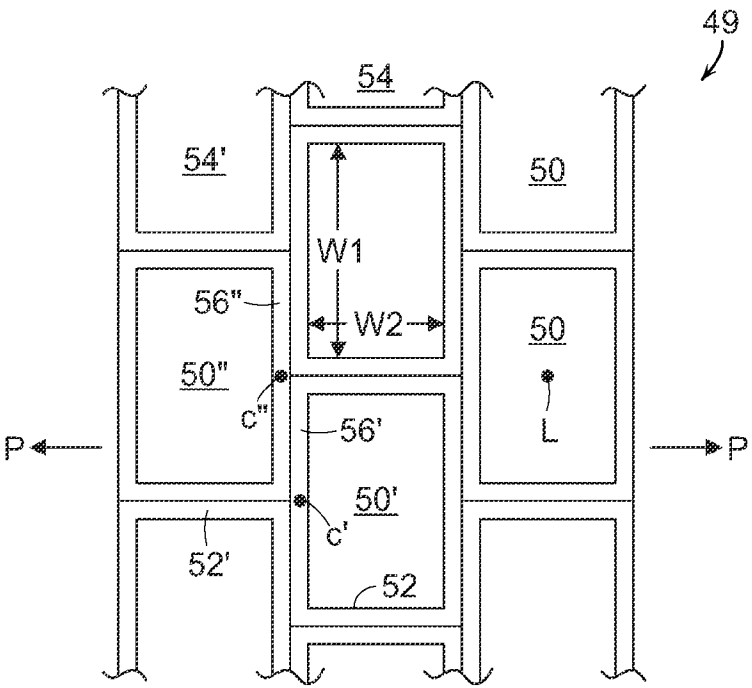
FIG. 4 is a schematic diagram of an embodiment of a microchannel plate.

In other embodiments, channels having other polygonal cross sections can be used. As an example, other four-sided or quadrilateral channels (e.g., rectangular, parallelograms, rhombus, and trapezoid, such as isosceles trapezoid) can be used. FIG. 4 shows an MCP 49 including channels 50 having cross sections (as taken perpendicularly to the length (L) of the channels) that are rectangular. As shown, rectangular channels 50 are connected (e.g., fused or bonded) together such that a first wall 52 between two channels in a first row 54 is offset and non-collinear with a second wall 52' nearest to the first wall 54 and between two channels in a second row 54' next to the first row 54. As a result, the arrangement of channels 50 is staggered, similar to the arrangement of bricks in a brick wall. Expressed another way, MCP 49 includes a first channel 50' having a side 56' with a center C', and a second channel 50" having a side 56" contacting side 56' with a center C". Centers C', C" are non-collinear in a direction perpendicular (line P) to the surface of side 56'.

In addition to enhancing the performance of MCP 49 by offsetting channels 50 as described herein, the performance of MCP 49 can also be enhanced by the cross-sectional shape of channel 50. More specifically, the cross sections of channels 50 (as taken perpendicularly to the length (L) of the channels) have an aspect ratio (W1:W2) that is not 1:1. The aspect ratio (W1:W2) can range from greater than 1:1 to approximately 5:1, where W1 corresponds to the larger side of the cross section. For example, the aspect ratio (W1:W2) can be greater than 1:1, greater than approximately 1.5:1, greater than approximately 2:1, greater than approximately 2.5:1, greater than approximately 3:1, greater than approximately 3.5:1, greater than approximately 4:1, or greater than approximately 4.5:1; and/or less than approximately 5:1, less than approximately 4.5:1, less than approximately 4:1, less than approximately 3.5:1, less than approximately 3:1, less than approximately 2.5:1, less than approximately 2:1, or less than approximately 1.5:1. Without being bound by theory, it is believed that having a non-1:1 aspect ratio can (assuming the wall thickness remains the same) increase the proportion of linear wall area, reduce the total volume per channel formed by the intersection of walls, and thus reduce the effective reaction product path length through the channel wall glass material, which can result in higher localized detection efficiency.

Figure 5:
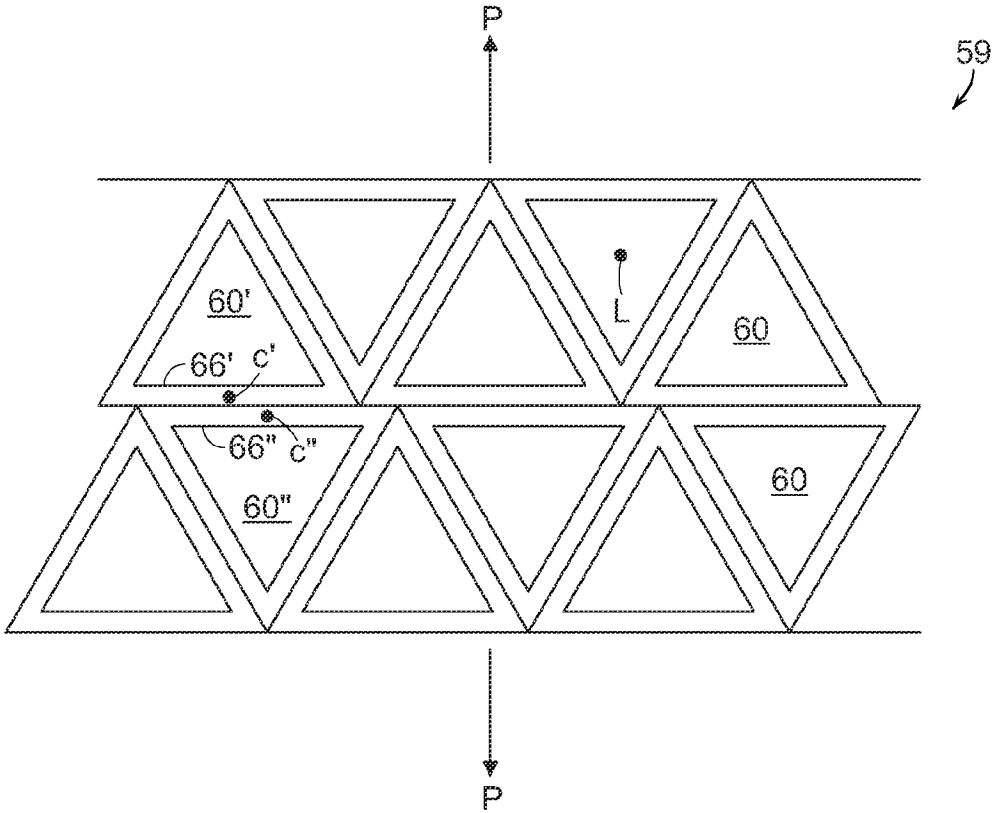
FIG. 5 is a schematic diagram of an embodiment of a microchannel plate.

As another example of channels having other polygonal cross sections, FIG. 5 shows an MCP 59 including channels 60 having cross sections (as taken perpendicularly to the length (L) of the channels) that are triangular (e.g., equilateral, isosceles, or scalene). As shown, MCP 59 includes a first channel 60' having a side 66' with a center C', and a second channel 60" having a side 66" contacting side 66' with a center C". Centers C', C" are non-collinear in a direction perpendicular (line P) to the surface of side 66'.

Figure 6:
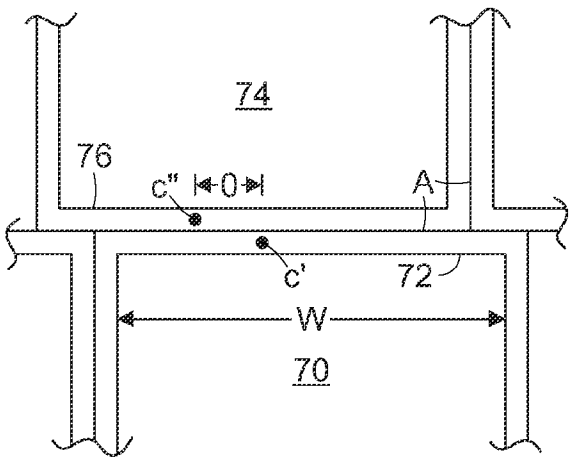
FIG. 6 is a schematic diagram of an embodiment of two adjoining channels.

The degree of offset can vary between two adjacent channels having sides that contact each other. Referring to FIG. 6, a first channel 70 includes a side 72 having a center C', and a second channel 74 adjoined to the first channel includes a side 76 contacting side 72 having center C". Channels 70, 74 can be any polygonal (e.g., square, rectangular or triangular) channel. As shown, center C' is offset or spaced from center C" by distance O, as taken in a direction parallel to sides 72, 76. When distance is O equals zero, channels 70, 74 are not offset (e.g., FIG. 3). Distance O can be expressed as a function of the distance (W) of side 72 or side 76. Distance O can range from greater than zero percent of W to less than 50% of W. For example, distance O can be greater than or equal to approximately 5% W, approximately 10% W, approximately 15% W, approximately 20% W, approximately 25% W, approximately 30% W, approximately 35% W, approximately 40% W, or approximately 45% W; and/or less than or equal to approximately 50% W, approximately 45% W, approximately 40% W, approximately 35% W, approximately 30% W, approximately 25% W, approximately 20% W, approximately 15% W, approximately 10% W, or approximately 5% W. While the sides or walls between two adjoining channels are shown as being divided by a clear line (A), the line represents half the thickness of the side/wall (in embodiments in which the channels have the same dimensions) and may not be visible in actual MCPs. In embodiments in which the channels have different dimensions, line A divides the thickness of the side/wall proportionally, according to the thicknesses of the channels prior to being joined together.

The MCPs described herein can include (e.g., be formed of) any composition capable of interacting with a selected radiation and/or particles and providing products that can be detected. Examples of compositions include neutron-sensitive glasses that include enriched boron-10 ($^{10}B$), or enriched boron-10 ($^{10}B$) and natural gadolinium (which includes the $^{155}Gd$ and $^{157}Gd$ isotopes), or enriched lithium-6 ($^{6}Li$). In operation, when an incident neutron strikes an MCP, the neutron is captured by a boron-10 atom, and an alpha particle ($^{4}He$) and a lithium-7 particle are released, as in the reaction below:

$$n+{}^{10}B\rightarrow{}^{7}Li+{}^{4}He+Q(2.8\ MeV),$$

where Q is the energy released in the reaction. One or both of the lithium-7 and helium-4 particles pass out of the glass and enter one or more adjacent 28, freeing electrons along the way. Concurrently, a DC bias voltage is applied between the electrodes such that second (output) electrode 24 has a more positive DC bias voltage than first (input) electrode 22. The DC bias voltage generates an electric field (e.g., about 1 kV/mm) that attracts free electrons toward the output electrode. As free electrons bounce against the channel walls, more electrons are released to form a cascade of electrons that is detected as a signal at the output electrode 6. Thus, plate (e.g., plate 26) acts as an electron multiplier. The signal is read out and sent to a signal processor, such as a coincidence unit described in U.S. Ser. No. 11/522,855, filed Sep. 18, 2006, and entitled "Neutron Detection, and U.S. Provisional Patent Application 60/893,484, filed on Mar. 7, 2007, and entitled "Radiation Detectors and Related Methods".

In addition to using boron-10 to capture neutrons, the neutron-sensitive composition can include natural gadolinium (Gd) to capture neutrons as in the following reactions:

$$n+{}^{155}Gd\rightarrow{}^{156}Gd+\text{gamma rays}+\text{beta particles}+Q(7.9\ MeV)$$

$$n+{}^{157}Gd\rightarrow{}^{158}Gd+\text{gamma rays}+\text{beta particles}+Q(8.5\ MeV)$$

The beta particles can generate an electron cascade similarly to the lithium-7 and helium-4 particles described above.

The neutron-sensitive composition can also include lithium-6 ($^{6}Li$) to capture neutrons in the following reaction:

$$n+{}^{6}Li\rightarrow{}^{3}H+{}^{4}He+Q(4.8\ MeV),$$

Specific compositions, including high temperature hydrogen reduction processes that can provide in an inner channel wall that is semiconducting so that a small bias or leakage current can flow when a high voltage is applied to the electrodes wall, and secondary electrons needed to form the electron cascade or avalanche can form within the hollow channel, are disclosed in Zhong and Chou, U.S. patent application Ser. No. 11/772,960, filed on Jul. 3, 2007, and entitled "Neutron Detection". Methods of making MCPs are also described in U.S. patent application Ser. No. 11/772,960.

The MCPs described herein can be used as a component of dual gamma and neutron detectors, as described in Feller et al., U.S. Provisional Patent Application 60/893,484, filed on Mar. 7, 2007, and entitled "Radiation Detectors and Related Methods", and as a component in the detection of backscattered neutrons, as described in Feller and White, U.S. patent application Ser. No. 11/689,705, filed on Mar. 22, 2007, and entitled "Neutron Detection".

While the above description is directed to neutrons, the devices and methods described herein are not so limited and can be applied to other particles, radiation, or any reaction products formed during bulk detection. For example, an MCP can include a composition including lead, which can, in the bulk of the composition, interact with incident gamma rays to produce fast photoelectrons capable of producing a detectable electron cascade.

All references, such as patents, patent applications, and publications, referred to above are incorporated by reference in their entirety.

Other embodiments are within the scope of the following claims.

What is claimed is:

1. An apparatus, comprising:

a first electrode;

a second electrode;

a first polygonal channel extending between the electrodes, the first channel having a first side having a center; and a second polygonal channel extending between the electrodes, the second channel having a second side, a portion of the second side facing the first side and contacting the first side, the second side having a center, wherein the center of the first side and the center of the second side are non-collinear in a direction perpendicular to a surface of the first side, and wherein the first and second channels do not have square cross sections perpendicular to longitudinal axes of the channels.

2. The apparatus of claim 1, wherein the first and second channels have only three sides each.

3. The apparatus of claim 1, wherein the first and second channels have rectangular cross sections perpendicular to longitudinal axes of the channels.

4. The apparatus of claim 3, wherein the rectangular cross sections have an aspect ratio greater than 1.5:1.

5. The apparatus of claim 3, wherein the rectangular cross sections have an aspect ratio of equal to or greater than approximately 2:1.

6. The apparatus of claim 1, wherein the channels comprise a composition capable of interacting with neutrons to form secondary electrons in the channels.

7. The apparatus of claim 6, wherein the composition comprises boron-10 isotope, natural gadolinium, both boron-10 isotope and natural gadolinium, or lithium-6 isotope.

8. The apparatus of claim 1, wherein the channels comprise a composition comprising an electron emissive portion.

9. The apparatus of claim 1, wherein the center of the first side and the center of the second side are spaced in a direction parallel to the first side by greater than or equal to approximately 10% of a distance of the first side.

10. The apparatus of claim 1, wherein the center of the first side and the center of the second side are spaced in a direction parallel to the first side by greater than or equal to approximately 20% of a distance of the first side.

11. A method, comprising:

contacting an apparatus with particles, the apparatus comprising a first electrode, a second electrode, a first polygonal channel extending between the electrodes, the first channel having a first side having a center, and a second polygonal channel extending between the electrodes, the second channel having a second side, a portion of the second side facing the first side and contacting the first side, the second side having a center, wherein the center of the first side and the center of the second side are non-collinear in a direction perpendicular to a surface of the first side, wherein the first and second channels do not have square cross sections perpendicular to longitudinal axes of the channels; and detecting electrons formed by contacting the apparatus with the particles.

12. The method of claim 11, wherein the particles comprise neutrons.

13. The method of claim 11, wherein the first and second channels have only three sides each.

14. The method of claim 11, wherein the first and second channels have rectangular cross sections perpendicular to longitudinal axes of the channels.

15. The method of claim 14, wherein the rectangular cross sections have an aspect ratio greater than 1.5:1.

16. The method of claim 14, wherein the rectangular cross sections have an aspect ratio of equal to or greater than approximately 2:1.

17. The method of claim 11, wherein the composition comprises boron-10 isotope, natural gadolinium, both boron-10 isotope and natural gadolinium, or lithium-6.

18. The method of claim 11, wherein the channels comprise a composition comprising an electron emissive portion.

19. The method of claim 11, wherein the center of the first side and the center of the second side are spaced in a direction parallel to the first side by greater than or equal to approximately 10% of a distance of the first side.

20. The method of claim 11, wherein the center of the first side and the center of the second side are spaced in a direction parallel to the first side by greater than or equal to approximately 20% of a distance of the first side.

* * * * *